United States Patent [19]

Kitchin et al.

[11] Patent Number: 4,472,497

[45] Date of Patent: Sep. 18, 1984

[54] WHITE LIGHT HANDLEABLE PHOTOGRAPHIC MATERIALS

[75] Inventors: Jonathan P. Kitchin, Ware, England; Robert F. Coles, Lake Elmo, Minn.

[73] Assignee: Minnesota Mining and Manufacturing Company, St. Paul, Minn.

[21] Appl. No.: 467,857

[22] Filed: Feb. 18, 1983

[51] Int. Cl.[3] ..... G03C 1/36

[52] U.S. Cl. ..... 430/606; 430/613; 430/597; 430/592; 430/593; 430/578; 430/594; 430/595; 430/591; 430/581; 430/570

[58] Field of Search ..... 430/606, 597, 592, 593, 430/594, 595, 591, 570, 581, 613, 578

[56] References Cited

U.S. PATENT DOCUMENTS

| | | | |
|---|---|---|---|
| Re. 28,208 | 10/1974 | Sato et al. | 430/606 |
| 3,237,008 | 2/1966 | Dostes et al. | 250/65 |
| 3,658,547 | 4/1972 | Shiba et al. | 96/101 |
| 3,671,254 | 6/1972 | Dostes et al. | 96/101 |
| 4,140,531 | 2/1979 | Jamieson | 96/94 R |
| 4,232,116 | 11/1980 | Jamieson | 430/510 |

*Primary Examiner*—Won H. Louie

*Attorney, Agent, or Firm*—Donald M. Sell; James A. Smith; Mark A. Litman

[57] ABSTRACT

Many photographic materials must be handled under special lighting conditions in order to prevent exposure of the material. The use of large concentrations of bleachable light absorbing layers over the photosensitive emulsion tends to leave an undesirable residual stain. The inclusion of a specific class of low intensity reciprocity failure inducers to silver halide emulsions enables the emulsions and their photographic articles to be safely handled under white light conditions.

23 Claims, No Drawings

WHITE LIGHT HANDLEABLE PHOTOGRAPHIC MATERIALS

BACKGROUND OF THE INVENTION

1. Field of the Invention

This invention relates to silver halide photographic materials which may be handled under normal lighting conditions without fogging and which are capable of recording images of high intensity light or other actinic radiation.

2. Prior Art

The majority of photographic recording materials require specially filtered and subdued light in order to be handled safely without fogging. This applies particularly to silver halide photographic recording materials which are, in general, more light sensitive than non-silver materials. Silver halide recording materials which have not been spectrally sensitized by the addition of sensitizing dye are normally only highly sensitive to ultraviolet and blue light. Such materials may be safely handled in subdued yellow or red light. It is very desirable to produce a silver halide photographic recording film which may be safely handled in bright white light. The benefits of this include ease of working and inspection of the material during exposure and processing, and generally more pleasant working conditions for the operators.

The term "white light" used herein is defined as the emission of a typical commercially available "white" or "warm white" fluorescent tube which has relatively little emission shorter than 400 nm wavelength, or longer than 700 nm. Various techniques have been employed in order to achieve some degree of white light handleability.

Silver halide materials which are intended for exposure to wavelengths outside the above range; e.g., direct X-ray recording materials or ultraviolet recording materials, may be afforded some degree of "white light handleability" by overcoating the radiation sensitive layer with a layer containing a filter dye. Typically, the dye will absorb visible light, particularly blue light, and prevent exposure of the radiation sensitive layer by this light. The filter dye is chosen such that it does not greatly interfere with intentional exposure of the material to U.V. or X-rays. Examples of constructions incorporating such filter layers are disclosed in U.S. Pat. Nos. 4,140,531 and 4,232,116 which employ blue absorbing dyes which are bleached during processing.

The improvement in white light handling safety which may be achieved by the use of filter layers is not normally very great unless very high dye loadings are used. Such high dye loading tends to cause problems of residual dye stain.

An alternative method for achieving handleability in white light is to add a substance to the radiation sensitive layer which causes desensitization to radiation of all wavelengths. Materials desensitized in this way must then be exposed to a very powerful light source, much brighter than the room light in which they can be handled. Silver halide materials desensitized by the addition of rhodium salts are disclosed, for example, in Japanese Patent Specification No. J5 6125-734. The white light handleability of materials desensitized in this way is not very great unless impractically high levels of desensitization are effected.

Materials for direct X-ray recording may be rendered handleable by the addition, to the silver halide layer, of compounds which desensitize the silver halide to visible (white) light, but not to X-rays. U.S. Pat. Nos. 3,671,254; 3,237,008 and 3,658,547 disclose examples of such components.

The most effective known method of imparting safe handling characteristics in white light is by the incorporation into the silver halide emulsion of compounds which induce a high degree of low intensity reciprocity failure (L.I.R.F.). This effect is described in *The Theory of the Photographic Process,* Ed. T. H. James, 4th Edition 1977, Macmillan, page 133. L.I.R.F. is an effect whereby a silver halide emulsion may become insensitive to low intensity exposures even at extended exposure times. It is possible by the use of specific additives to accentuate this effect to such an extent that a silver halide emulsion cannot be fogged by low intensity light even after many hours exposure. By suitable choice of silver halide emulsion and additive it is possible to arrange that the normal level of white room-lighting is below the lower limit of intensity by which the emulsion can be exposed. Emulsions modified in this way may still be exposed by exposing radiation of higher intensity than normal room light.

Compounds which promote this effect will hereafter be referred to as "L.I.R.F. inducers". The application of L.I.R.F. inducers to white light handleable photographic film has been described in Professional Printer, 1981, Vol. 25(2), page 9.

There are many classes or organic compounds which act as desensitizers towards silver halide emulsions; see, for example, P. Glafkides, *Photographic Chemistry,* Chapter XLII, Fountain Press, 1960. Classes of organic compound which are known to form derivatives which may act as desensitizers include: phenazines, tetrazines, quinoxalines, aromatic nitro compounds, azo dyes, anthraquinones, diphenyl methanes, triphenylmethanes, cyanines, nitrated cyanines, styryl derivatives, styryl vinyl derivatives, benzopyrilium derivatives furyl vinyl quinolines, methine-anthraquinone derivatives, anils, aza cyanines, triazoles, dipyridine derivatives and phenazine N-oxides. Many desensitizers for silver halide emulsions also act to some extent as L.I.R.F. inducers. (J. Opt. Soc. Amer., 1955, 45, 15; and Phot. Sci. Eng., 1967, 11, 82). However, not all compounds which are known to be desensitizers are equally efficient in this respect. A compound could not be predicted to be useful as a L.I.R.F. inducer for white light handleable film simply from the knowledge that it is a desensitizer. Furthermore, not all compounds which are L.I.R.F. inducers are equally useful to white light handling film, since many such compounds cause the latent image present on imaged film to fade when the film is exposed to room light even though the intensity of the room light may be insufficient to cause fogging.

It is an object of the present invention to provide white light handleable photographic elements incorporating L.I.R.F. inducers.

BRIEF DESCRIPTION OF THE INVENTION

According to the present invention, there is provided a photographic element which exhibits safe handling characteristics under white light (as defined herein) and is capable of recording images of higher intensity visible light or other actinic radiations, the element comprising one or more layers of silver halide emulsion at least one of said layers containing an effective amount of a compound of the formula:

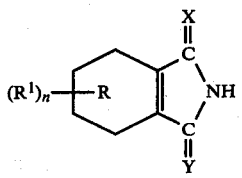

(I)

in which:

R represents an aromatic ring, a 4, 5, 6, 7 tetra hydrogenated aromatic ring, a nitrogen-containing heterocyclic ring or a sulphur-containing heterocyclic ring (preferably 5-, 6- or 7-membered rings of C, S, N, Se and O ring atoms), n is 0 or an integer of from 1 to 4 so that R may optionally possess up to 4 $R^1$ substituents on the ring, each $R^1$ may be the same or different and represents a substituent which individually or cumulatively does not substantially deleteriously affect the desensitizing properties of the compound relative to the equivalent compound in which n=0, any two adjacent $R^1$ groups optionally forming the necessary atoms selected from carbon, nitrogen, oxygen and sulphur to complete one or more fused rings having up to 12 atoms in the skeletal ring structure, X and Y may be the same or different and represent:

a divalent residue obtained by the removal of two active hydrogen atoms from a single nitrogen or carbon atom in an organic compound, the skeletal structure of which contains up to 20 atoms selected from carbon, oxygen, sulphur and nitrogen, $=N-R^2$ in which $R^2$ is hydrogen or a substituent which does not substantially deleteriously affect the desensitizing properties of the equivalent compound in which $R^2$ is hydrogen, and one of X and Y can additionally represent =O.

DETAILED DESCRIPTION OF THE INVENTION

It has been found that the compounds of formula (I) act as L.I.R.F. inducers and do not cause latent image fading in silver halide emulsions and are therefore useful in the production of photographic elements which may be handled without fogging under white light; e.g. normal lighting conditions. The compounds may be incorporated into the emulsion before or after imagewise exposure. Certain compounds within the scope of formula (I) are known and have been used as dyestuffs and colorants; see, for example, U.S. Pat. Nos. 3,646,033; 3,994,921 and 4,217,309 and British Pat. No. 1,219,041. There is also a passing reference in U.S. Pat. No. 4,030,932 to the effect that certain compounds which fall within the scope of formula (I) above are desensitizers although that patent is directed towards sensitizers in which an alkyl or substituted alkyl group is present in the 2-position of an isoindole nucleus. However, heretofore it has not been appreciated in the prior art that compounds of formula (I) possess suitable properties for use in white light handleable films. These properties include the ability to desensitize silver halide to normal lighting conditions while allowing the silver halide to remain sensitive to intense visible or ultraviolet exposing devices or X-ray exposing devices.

It is believed that compounds which are of potential value as L.I.R.F. inducers for use in our invention must be capable of accepting an electron which has been excited to the conduction band of the silver halide crystal. There appears to be a strong correlation between the ability of a compound to perform this function and the cathodic half wave potential of the compound. This relationship is described, for example, in Phot. Sci. Eng. 1973, 17, 235 and Phot. Sci. Eng. 1974, 18, 261. Preferred L.I.R.F. inducers of this invention are those having a cathodic half wave potential less negative than −1.0 volts measured versus a normal calomel electrode.

In general the nucleus:

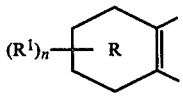

(2)

in formula (I) does not appear to have a significant effect on the desensitizing properties. The ring R is preferably an optionally substituted aromatic ring. However, other ring systems are suitable as defined above, an example of which includes dithiacyclohexenylene. The substituent(s) $R^1$ may be selected from a wide range of groups including halogen; e.g., chlorine, hydroxy, alkyl or alkenyl, containing 1 to 8 carbon atoms, cycloalkyl; e.g., cyclohexyl, alkoxy containing 1 to 8 carbon atoms, aryl containing up to 8 carbon atoms; e.g., phenyl, substituted phenyl, acylamine, etc. The above aliphatic substituents may themselves be substituted with, for example, phenyl, hydroxyl or halogen, carboxyl, esterified carboxyl, carbamoyl, sulpho or esterified sulpho group.

The selection of these substituents and the ring R may affect properties such as the solubility of the compounds as is well known in the cyanine dye art.

Preferably the nucleus of formula (2) has the formula:

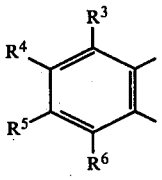

(3)

in which each of $R^3$ to $R^6$ are independently selected from hydrogen, halogen, alkyl or alkoxy containing up to 8 carbon atoms, aryl containing up to 8 carbon atoms and acylamine, any two adjacent $R^3$ to $R^6$ groups optionally forming the necessary atoms selected from carbon, nitrogen, oxygen and sulphur to complete one or more fused rings having up to 12 carbon atoms in the skeletal ring structure.

The substituents X and Y which have a significant effect upon the desensitizing properties of the compound of formula (I) may be selected from a wide range of groups within the above definitions. Examples of suitable substituents for X and Y include those of the following formulae (4) to (8):

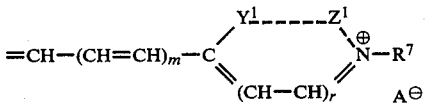

(4)

in which:

$A^\ominus$ represents an anion, m is 0, 1 or 2, r is 0 or 1, $Y^1$ is a carbon, nitrogen, oxygen or sulphur atom, $Z^1$ represents the necessary atoms to complete a 5- or 6-membered ring which may optionally include one or more further fused rings; see, for example, U.S. Pat. Nos. 3,646,033; 3,816,141 and 4,030,932, and $R^7$ represents an alkyl, sulphoalkyl, or carboxyalkyl group containing up to 8 carbon atoms, (examples of groups of formula (4) include:

3-methylthiazolinium linked at the 2-position, 3-ethylblenzothiazolium linked at the 2-position, 3-methylbenzoxazolium linked at the 2-position, 1-methylpyridinium linked at the 2-position, and 1-methylpyridinium linked at the 4-position.)

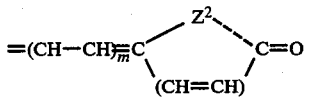

(5)

in which:

m is 0, 1 or 2, p is 0 or 1, and $Z^2$ represents the non-metallic atoms required to complete an acidic nucleus of the type present in merocyanine dyes; see, for example, U.S. Pat. Nos. 3,646,033 and 4,030,932, (examples of groups of formula (5) include:

3-methyl-1-phenyl-pyrazolin-5-one linked at the 4-position, 3-phenyl-(4H)-isoxazolone linked at the 4-position, 2,4,6-triketohexahydropyrimidine linked at the 5-position, 3-ethylrhodanine linked at the 5-position.)

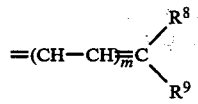

(6)

in which:

m is 0, 1 or 2, and $R^8$ and $R^9$ may be the same or different and each represent an electron withdrawing substituent such as CN, acyl having up to 8 carbon atoms, carboalkoxy having up to 8 carbon atoms, sulfonyl, nitroaryl having up to 16 carbon atoms, etc.; see, for example, U.S. Pat. No. 3,646,033, (examples of groups of formula (6) include:

$R^8=R^9=CO_2C_2H_5$ $R^8=CN$, $R^9=-SO_2Ph$ $R^8=CN$, $R^9=p_9C_6H_4NO_2$ $R^8=-CO-CH_3$, $R^9=-CO_2C_2H_5$.)

$$=(CH-CH)_mN-R^{10} \quad (7)$$

in which:

m is 0, 1 or 2, and $R^{10}$ represents a hydrogen atom, an alkyl group having up to 8 carbon atoms; e.g., methyl and ethyl, or an aryl group having up to 8 carbon atoms; e.g., phenyl, or $$=(CH-CH)_mQ \quad (8)$$

in which:

m is 0, 1 or 2, and

Q represents oxime, hydrazone or aryl hydrazone in which the aryl group contains up to 8 carbon atoms.

An example of a group of formula (8) is paranitrophenylhydrazone.

Preferably at least one of X and Y represents a divalent group linked via a carbon atom or nitrogen atom, which atom is separated by one carbon atom from a quaternized nitrogen atom. Examples of such substituents include those of formula (4) above, in which r=0; a preferred example being:

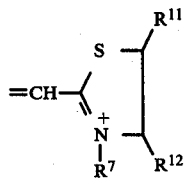

(9)

in which:

$R^7$ is as defined above and is preferably methyl ethyl, or $-(CH_2)_mCO_2\ominus$, in which m is 1 or 2, and $R^{11}$ and $R^{12}$ are the same and represent H or form the necessary carbon atoms to complete one or more fused benzene rings.

More preferably either X and Y represent such groups or one of X and Y represents such a group and the other of X and Y is =NH.

It should be appreciated that many of these compounds may exist in more than one form: for example, 3-amino isoindolines may exist in equilibrium with the tautomeric 3-aminoisoindolenine.

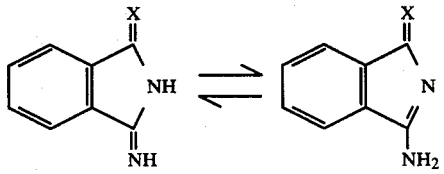

Furthermore, many of the compounds of formula (I) may be capable of existing in protonated or unprotonated forms depending on the pH of the environment; for example:

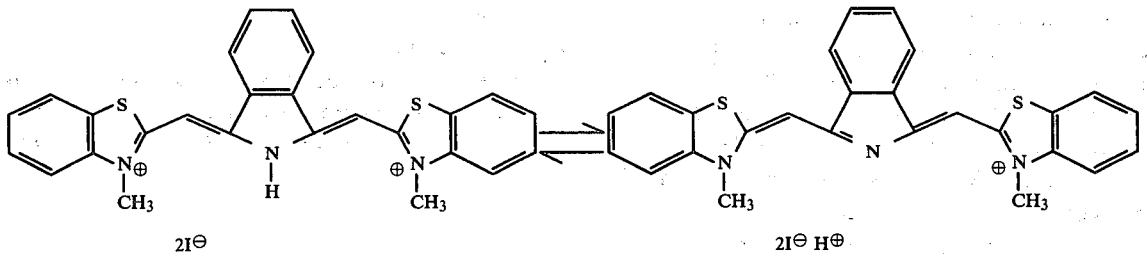

Only the isoindoline forms of the compounds will be specifically referred to herein with reference to formula (I) but it is to be understood that many of these compounds may exist in equilibrium (tautomeric or conjugate) base) forms. The compounds referred to in formula (I) are to be understood to include any alternative equilibrium forms of such structures.

The compounds of formula (I) may be added at any stage during the preparation of the silver halide emulsion. Additionally, it is possible to apply the compounds to the photographic element in the form of a solution, which solution may be applied subsequent to exposure but prior to development in order that development may be carried out in lighting sufficiently bright to permit inspection of the photographic element. Preferably, the compound is incorporated during the emulsion preparation.

In order to facilitate their incorporation into the emulsion, the compounds of the formula (I) preferably have a solubility which is greater than $10^{-4}$ molar in one or more water miscible solvent at 40° C. Typical solvents include one or any combination of methanol, ethanol, water, acetone, pyridine, 2-methoxyethanol, dimethylformamide, dimethyl sulfoxide, 0.1N aqueous sodium hydroxide and 0.1N aqueous nitric acid.

The amount of compound employed varies with the degree of desensitization required and the L.I.R.F. inducing properties of the particular compound employed. Generally concentrations within the range 0.01 to 10 g per mole of silver are used and usually within the range 0.1 to 5 g per mole of silver.

Suitable silver halide emulsions for use in the invention include silver chloride, silver bromide, silver chlorobromide, silver iodobromide, silver iodochlorobromide and silver iodochloride emulsions.

The emulsions preferably employ gelatin as a binder. However, the gelatin may be wholly or partly replaced by other polymers including chemically modified gelatin, albumin, agar-agar, arabic acid, alginic acid and derivatives thereof, starch and derivatives thereof, cellulose derivatives; e.g., cellulose ethers, partially hydrolyzed cellulose acetate, carboxymethyl cellulose, etc., polyvinyl alcohol, polyvinylpyrrolidone, methacrylic acid, or derivatives thereof; e.g., esters, amides and nitriles, vinyl polymers; e.g., vinyl ethers and vinyl esters.

The silver halide emulsion employed in this invention may be chemically sensitized. Chemical sensitization may be carried out by heating the emulsion in the presence of active gelatin or sulfur sensitizers such as dodium thiosulfate or selenium, and noble metal sensitizers. Alternatively, or in addition, the emulsion may be reduction sensitized, for example, by treating at low pAg (less than 5) and high pH (greater than 8) or through the use of reducing agents such as stannous chloride, thiourea dioxide and amine boranes.

The silver halide elements may contain any of the conventional emulsion additives which are known in the art including: development accelerating compounds; e.g., polyalkylene glycols, cationic surfactive compounds of the ammonium, sulfonium and phosphonium types and thioethers; antifoggants and stabilizers; e.g., thiazolium salts, azaindenes; e.g., hydroxytetraazaindenes, nitroindazoles, nitrobenzimidazoles, mercaptotetrazoles, divalent salts of cadmium, cobalt, mercury, zinc or manganese and benzene thiosulfonates.

The silver halide elements may also contain conventional additives such as coating aids, hardeners, plasticizers and antistatic agents.

Further exemplification of conventional silver halide emulsion preparation conditions and addenda is given in Research Disclosure 1978, 176, 17643.

The silver halide elements of this invention may additionally contain any of the conventional desensitizers known in the art.

Various methods are known for the preparation of substituted isoindoline derivatives. A convenient preparative procedure is that disclosed in U.S. Pat. No. 3,646,033. According to this method, 1,3-diiminoisoindoline (1.2 moles) is heated with an active methylene compound, an active methyl compound, or a compound possessing an active —$NH_2$ group (1 mole). The solvent may be e.g., water, ethanol or dimethylformamide. The monosubstituted product will normally crystallize out from the reaction mixture. The monosubstituted product may be further substituted by treatment with the same or a different active hydrogen compound.

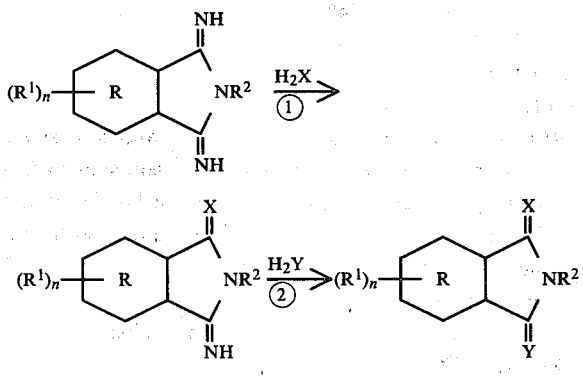

The preparation of compounds in which one of X and Y is =0 is disclosed in Chem. Ber. 1967, 100, 2261. The other substituents of X and Y may be introduced in the manner disclosed in the above reaction scheme.

The invention will now be illustrated by the following Examples in which the reference numbers for the various compounds will be identified in the following Table 1.
TABLE 1
| Compound No. | Formula |
|---|---|
| 1 | 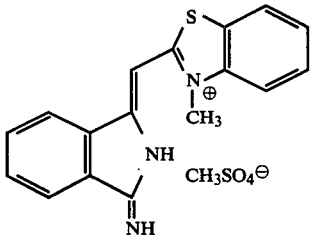 |
| 2 | 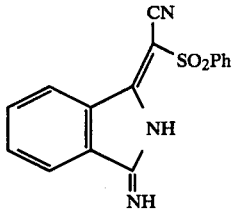 |
| 3 | 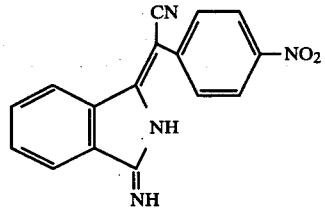 |
| 4 | 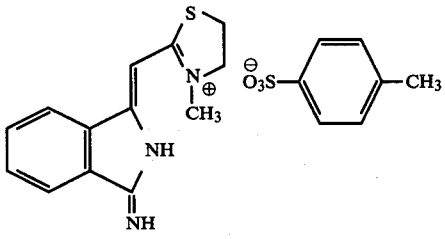 |
| 5 | 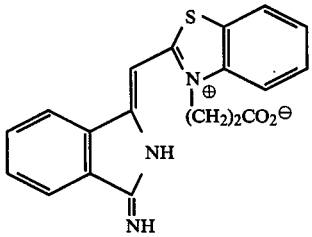 |
| 6 | 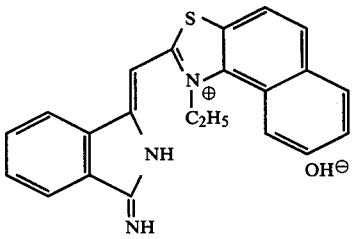 |

TABLE 1-continued
| Compound No. | Formula |
|---|---|
| 7 | 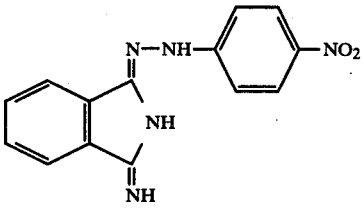 |
| 8 | 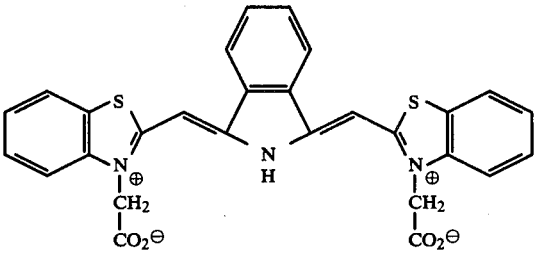 |
| 9 | 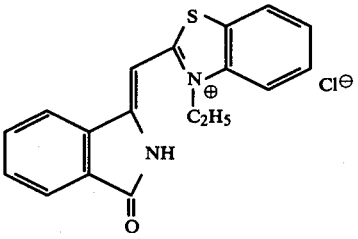 |
| 10 | 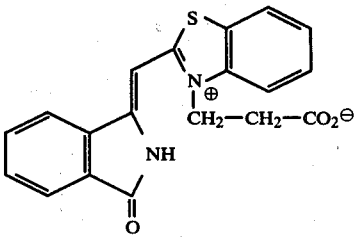 |
| 11 | 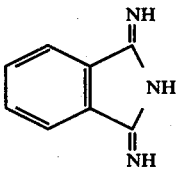 |
| 12 | 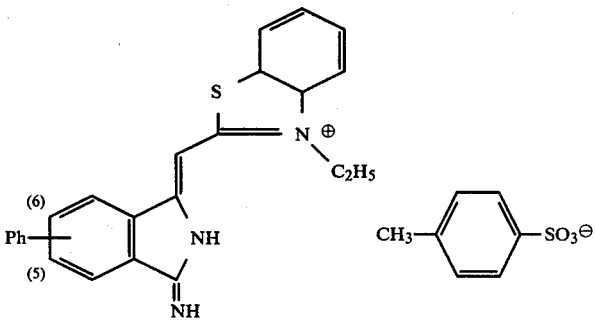 (a mixture of 5 and 6 substitution) |

TABLE 1-continued

| Compound No. | Formula |
|---|---|
| 13 (prior art) | 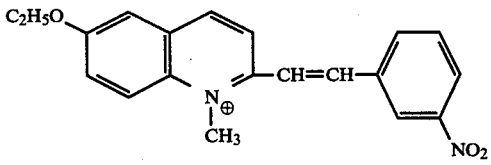 $CH_3C_6H_4SO_3^{\ominus}$ Pinakryptol yellow |
| 14 (prior art) | 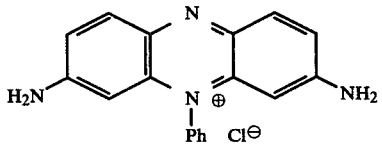 Phenosafranine |
| 15 (prior art) | 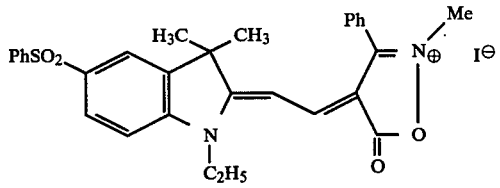 British Patent No. 1,470,601 |

EXAMPLE

A fine-grained silver halide emulsion consisting of 98% silver chloride and 2% silver bromide was prepared by a conventional double jetting technique. The emulsion was coagulated with sodium sulfate and washed normally. The coagulum was reconstituted with gelatin solution to give a final gelatin content of 80 g per mole of silver. At coating, the emulsion was divided into 0.1 mole portions and each additive, as indicated in Table 2, was added to a respective portion of the emulsion in methanol solution prior to addition of wetting agent and hardener. The pH of the emulsions was adjusted to pH 5 and the emulsions were coated on polyester base.

The coatings were exposed under two conditions:

(a) behind a step density wedge to a 5 kW metal halide doped mercury discharge lamp (Philips HPM 17) at a distance of 1 meter, and (b) a low intensity exposure, a 80 Watt "warm white" fluorescent tube at a distance of 5 feet for 5 minutes.

The coatings were developed in a phenidonehydroquinone graphic arts rapid access developer for 20 seconds at 40 C and fixed in Fixaplus, a thiosulfate fixer commercially available from May & Baker, at 40 C for 20 seconds. The results of the exposures are reported in Table 2 in which:

Column A reports the relative exposure required to give a density of 1.0 when the material was exposed with a 5000 Watt Philips HMP 17 metal halide discharge lamp for 5 seconds at a distance of 1 meter through a continuous density wedge.

Column B reports the average contrast of the coating exposed as in Column A and measured between a density of 0.04 and 0.2 above background fog.

Column C reports the fog density which resulted from exposure of the coating to an 80 Watt Thorn "warm white" fluorescent tube at a distance of 1.5 meters of 5 minutes.

TABLE 2

| Compound No. (g/mole silver) | A | B | C |
|---|---|---|---|
| 1 (0.2) | 19.9 | 0.73 | 0.06 |
| 2 (0.2) | 22.9 | 0.34 | 0.09 |
| 3 (0.4) | 6.0 | 0.34 | 0.22 |
| 4 (0.1) | 19.9 | 0.64 | 0.08 |
| 5 (0.2) | 15.1 | 0.62 | 0.07 |
| 6 (0.2) | 8.7 | 0.44 | 0.14 |
| 7 (0.2) | 4.3 | 0.39 | 0.83 |
| 8 (0.1) | 15.1 | 0.47 | 0.11 |
| 9 (0.8) | 28.1 | 0.53 | 0.06 |
| 10 (0.8) | 12.5 | 0.53 | 0.06 |
| 11 (1.0) | 13.5 | 0.49 | 0.10 |
| No addition | 1.0 | 0.73 | 3.50 |
| 12 (0.8) | 26.5 | 0.57 | 0.06 |
| 13 (0.1) | 33.0 | 0.52 | 0.14 |
| 14 (0.1) | 10.5 | 0.53 | 0.30 |
| 15 (0.1) | 8.9 | 0.94 | 0.55 |

The compounds which are most useful for imparting white light handleability to a silver halide material are those which have a small effect on the sensitivity towards high intensity exposure and a large effect in reducing the sensitivity of the emulsion to low intensity (room light exposure). Thus, the most effective L.I.R.F. inducers should have a low value in both Columns A and C in Table 2. It will be noted from Table 2 that the compounds used in accordance with the invention compare favorably with those of the prior art and in many cases are significantly superior as L.I.R.F. inducers.

We claim:

1. A photographic element comprising one or more layers of silver halide emulsion, at least one of said layers containing an effective amount of one or more additives such that the element exhibits safe handling characteristics in white light and is capable of recording images of higher intensity light or other actinic radiations, characterized in that said additive is a compound of the general formula:

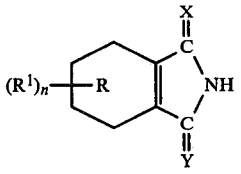

(I)

in which:

R represents an aromatic ring, a 4-, 5-, 6-, 7-tetra hydrogenated aromatic ring, a nitrogen-containing heterocyclic ring or a sulphur-containing heterocyclic ring, n is 0 or an integer from 1 to 4 so that R may optionally possess up to 4 $R^1$ substituents on the ring, each $R^1$ may be the same or different and represents a substituent which individually or cumulatively does not substantially deleteriously affect the desensitizing properties of the compound relative to the equivalent compound in which n=0, any two adjacent $R^1$ groups optionally forming the necessary atoms selected from carbon, nitrogen, oxygen and sulphur to complete one or more fused rings having up to 12 atoms in the skeletal ring structure, X and Y may be the same or different and represent:

a divalent residue obtained by the removal of two active hydrogen atoms from a single nitrogen or carbon atom in an organic compound, the skeletal structure of which contains up to 20 atoms selected carbon, oxygen, sulphur and nitrogen, $=N-R^2$ in which $R^2$ is hydrogen or a substituent which does not substantially deleteriously affect the desensitizing properties of the equivalent compound in which $R^2$ is hydrogen, and one of X and Y can additionally represent =O.

2. A photographic element comprising one or more layers of silver halide emulsion, at least one of said layers containing an effective amount of one or more additives such that the element exhibits safe handling characteristics in white light and is capable of recording images of higher intensity light or other actinic radiations, characterized in that said additive is a compound of the general formula:

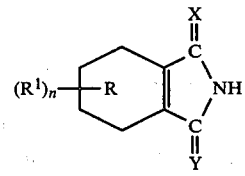

(I)

in which:

R represents a substituted or unsubstituted benzene ring, n is 0 or an integer from 1 to 4 so that R may optionally possess up to 4 $R^1$— substituents on the ring, each $R^1$— may be the same or different and represents a substituent which individually or cumulatively does not substantially deleteriously affect the desensitizing properties of the compound relative to the equivalent compound in which n=0, any two adjacent $R^1$— groups optionally forming the necessary atoms selected from carbon, nitrogen, oxygen and sulphur to complete one or more fused rings having up to 12 atoms in the skeletal ring structure, X and Y may be the same or different and represent:

a divalent residue obtained by the removal of two active hydrogen atoms from a single nitrogen or carbon atom in an organic compound, the skeletal structure of which contains up to 20 atoms selected carbon, oxygen, sulphur and nitrogen, $=N-R^2$— in which $R^2$— is hydrogen or a substituent which does not substantially deleteriously affect the desensitizing properties of the equivalent compound in which $R^2$— is hydrogen, one of X and Y can additionally represent =O, and wherein at least one of X and Y are selected from:

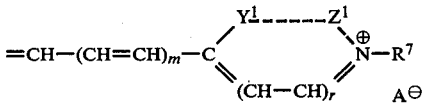

(4)

in which:

$A^\ominus$ represents an anion, m is 0, 1 or 2, r is 0 or 1, $Y^1$ is a carbon, nitrogen, oxygen or sulphur atom, $Z^1$ represents a bond or any necessary atoms to complete a 5- or 6-membered ring which may optionally include one or more further fused rings, and $R^7$ represents an alkyl, sulfoalkyl or carboxyalkyl group containing up to 8 carbon atoms,

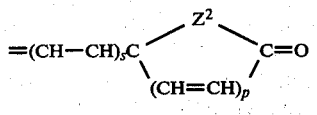

in which:

s is 0, 1 or 2, p is 0 or 1, and $Z^2$ represents the non-metallic atoms required to complete an acidic nucleus of the type present in merocyanine dyes,

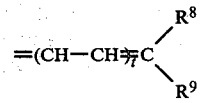

in which:

t is 0, 1 or 2, and $R^8$ and $R^9$ may be the same or different and each represent an electron withdrawing substituent such as CN, acyl having up to 8 carbon atoms, carboalkoxy having up to 8 carbon atoms, sulfonyl, nitroaryl having up to 8 carbon atoms, $=(CH-CH)_uN-R^{10}$ in which:

u is 0, 1 or 2, and $R^{10}$ represents a hydrogen atom, an alkyl group having up to 8 carbon atoms, or an aryl group having up to 8 carbon atoms, or $=(CH-CH)_vQ$ in which:

v is 0, 1 or 2, and

Q represents oxime, hydrazone or aryl hydrazone in which the aryl group contains up to 8 carbon atoms.

3. A photographic element as claimed in claim 2, characterized in that X and Y are the same and each represent a divalent group linked via a carbon or nitrogen atom, which atom is separated by one carbon atom from a quaternized nitrogen atom.

4. A photographic element as claimed in claim 2, characterized in that X represents a divalent group linked via a carbon or nitrogen atom, which atom is separated by one carbon atom from a quaternized nitrogen atom, and Y represents =N—H.

5. A photographic element as claimed in claim 2 characterized in that X represents:

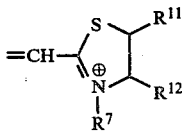

in which:

$R^7$ is as defined in claim 2, and $R^{11}$ and $R^{12}$ are the same and represent H or form the necessary atoms to complete one or more fused benzene rings.

6. A photographic element as claimed in claim 5, characterized in that $R^7$ represents methyl, ethyl or $-(CH_2)_mCO_2^-$, in which m is 1 or 2.

7. A photographic element as claimed in claim 1, characterized in that one of X and Y represent =O.

8. A photographic element as claimed in claim 2, characterized in that R represents:

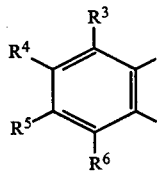

in which each of $R^3$ to $R^6$ are independently selected from hydrogen, halogen, alkyl or alkoxy containing up to 8 carbon atoms, aryl containing up to 8 carbon atoms and acylamine, any two adjacent $R^3$ to $R^6$ groups optionally forming the necessary atoms selected from carbon, nitrogen, oxygen and sulphur to complete one or more fused rings having up to 12 carbon atoms in the skeletal ring structure.

9. A photographic element as claimed in claim 2, characterized in that the or each substituent $R^1$ is selected from halogen, alkyl or alkenyl containing 1 to 8 carbon atoms, cycloalkyl, alkoxy containing 1 to 8 carbon atoms, aryl containing up to 8 carbon atoms and acylamine.

10. A photographic element as claimed in claim 2, characterized in that the compound has the formula:

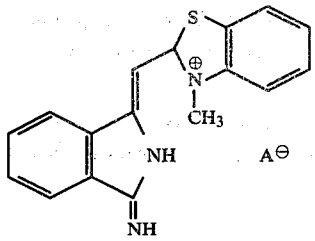

in which $A^-$ represents an anion.

11. A photographic element as claimed in claim 2, characterized in that the compound has the formula:

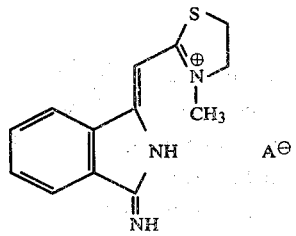

in which $A^-$ represents an anion.

12. A photographic element as claimed in claim 2, characterized in that the compound has the formula:

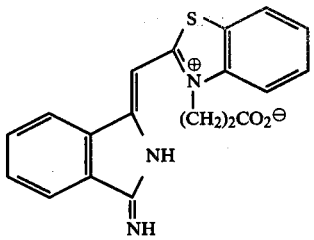

13. A photographic element as claimed in claim 2, characterized in that the compound is the product of the reaction:

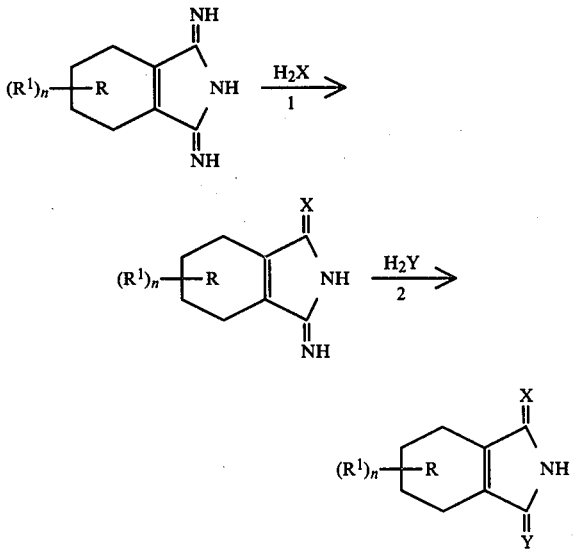

in which $R^1$, R, X, Y and n are as defined in claim 1, provided that neither X nor Y is =O, provided that when X is =NH step 1 is omitted and when Y is =NH step 2 is omitted.

14. A photographic element as claimed in claim 2, characterized in that the compound is the product of the reaction:

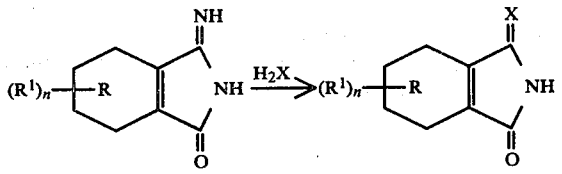

15. A photographic element as claimed in claim 2, characterized in that the compound has a cathodic half wave potential which is less negative than −0.1 volts measured versus a normal calomel electrode.

16. A photographic element as claimed in claim 2, characterized in that the compound has a solubility which is greater than $10^{-4}$ molar in a water-miscible solvent at 40° C.

17. A photographic element as claimed in claim 4, characterized in that at least one emulsion layer contains from 0.01 to 10 g of the compound per mole of silver.

18. A photographic element as claimed in claim 17, characterized in that each said at least one layer contains from 0.1 to 5 g of the compound per mole of silver.

19. A photographic element as claimed in claim 8, characterized in that X and Y are the same and each represent a divalent group linked via a carbon or nitrogen atom, which atom is separated by one carbon atom from a quaternized nitrogen atom.

20. A photographic element as claimed in claim 8, characterized in that X represents a divalent group linked via a carbon or nitrogen atom, which atom is separated by one carbon atom from a quaternized nitrogen atom, and Y represents =N—H.

21. A photographic element as claimed in claim 8, characterized in that X represents:

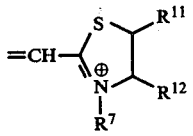

in which:

$R^7$ is as defined in claim 2, and $R^{11}$ and $R^{12}$ are the same and represent H or form the necessary atoms to complete one or more fused benzene rings.

22. A photographic element as claimed in claim 23, characterized in that $R^7$ represents methyl, ethyl or $-(CH_2)_mCO_2^-$, in which m is 1 or 2.

23. A photographic element as claimed in claim 8, characterized in that one of X and Y represent =O.

* * * * *